US009874093B2

(12) United States Patent
Skerry

(10) Patent No.: US 9,874,093 B2
(45) Date of Patent: Jan. 23, 2018

(54) JAM CLEARING PROCESS FOR ROTARY TELEMETRY TOOLS

(71) Applicant: Schlumberger Technology Corporation, Sugar Land, TX (US)

(72) Inventor: Thomas Leslie Skerry, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/344,894

(22) Filed: Nov. 7, 2016

(65) Prior Publication Data

US 2017/0130578 A1 May 11, 2017

Related U.S. Application Data

(60) Provisional application No. 62/251,188, filed on Nov. 5, 2015.

(51) Int. Cl.
*E21B 47/00* (2012.01)
*E21B 47/18* (2012.01)

(52) U.S. Cl.
CPC ..... *E21B 47/18* (2013.01); *E21B 47/00* (2013.01); *E21B 47/182* (2013.01); *E21B 47/185* (2013.01); *E21B 47/187* (2013.01)

(58) Field of Classification Search
CPC ..... E21B 47/00; E21B 47/18; E21B 47/182; E21B 47/185; E21B 47/187
See application file for complete search history.

(56) References Cited

U.S. PATENT DOCUMENTS 3,309,656 A 3/1967 Godbey
5,237,540 A * 8/1993 Malone ..... E21B 47/18 175/40
2008/0002525 A1* 1/2008 Pratt ..... E21B 47/18 367/84

* cited by examiner

*Primary Examiner* — Hai Phan
*Assistant Examiner* — Franklin Balseca

(57) ABSTRACT

A clearing or unjamming process utilizes bidirectional agitation and non-deterministic behavior to clear debris that is jamming a downhole rotary tool. In accordance to at least one embodiment the clearing or unjamming process uses irregular oscillation of the jamming debris which may be produced by varying pause times in a bidirectional movement of the rotor. In some embodiments the rate of acceleration and deceleration of the rotor is maintained constant during the unjamming process.

10 Claims, 4 Drawing Sheets

JAM CLEARING PROCESS FOR ROTARY TELEMETRY TOOLS

CROSS-REFERENCE TO RELATED APPLICATION

This application claims the benefit of and priority to U.S. Provisional Application No. 62/251,188, filed Nov. 5, 2015, which is incorporated herein by reference in its entirety.

BACKGROUND

This section provides background information to facilitate a better understanding of the various aspects of the disclosure. It should be understood that the statements in this section of this document are to be read in this light, and not as admissions of prior art.

It is desirable to measure or "log," as a function of depth, various properties of earth formations penetrated by a borehole while the borehole is being drilled, rather than after completion of the drilling operation. It is also desirable to measure various drilling and borehole parameters while the borehole is being drilled. These technologies are known as logging-while-drilling ("LWD") and measurement-while-drilling ("MWD"), respectively. Measurements are generally taken with a variety of sensors mounted within a drill collar above, but preferably close, to a drill bit which terminates a drill string. Sensor responses, which are indicative of the formation properties of interest or borehole conditions or drilling parameters, are then transmitted to the surface of the earth for recording and analysis.

The most common technique used for transmitting MWD data utilizes drilling fluid as a transmission medium for acoustic waves modulated downhole to represent sensor response data. The modulated acoustic waves are subsequently sensed and decoded at the surface of the earth. One type of telemetry device is a rotary valve or "mud siren" pressure pulse generator which repeatedly interrupts the flow of the drilling fluid, and thus causes varying pressure waves to be generated in the drilling fluid at a carrier frequency that is proportional to the rate of interruption.

SUMMARY

In accordance to one or more embodiments a method of clearing debris from a downhole rotary tool such as a telemetry tool includes applying bi-directional agitation with a pause time between rotor rotation direction changes, wherein the pause time occurs when the rotor is in, or proximate to, a full open position relative to a stator. In accordance to one or more embodiments the pause time is random.

A method according to one or more embodiments includes operating a rotary tool, such as a pulse signal device, in a wellbore, the tool including a motor rotating a rotor relative to a stator to alter a fluid pathway to produce modulated pressure pulses in a drilling fluid column, detecting a jam in the rotary tool, initiating an irregular oscillation clearing process by rotating the rotor to a full open position, performing a first oscillation process until the jam is cleared or otherwise moving to a second oscillation process, the first oscillation process including rotating the rotor in a first direction until jammed and then switching directions and rotating the rotor in a second direction to the full open position and pausing for a first pseudo random pause time; and rotating the rotor in the second direction until jammed and then switching directions and rotating the rotor in the first direction to the full open position and pausing for the first pseudo random pause time; and performing a second oscillation process including rotating the rotor in a first direction until jammed and then switching directions and rotating the rotor in a second direction to the full open position and pausing for a second pseudo random time, wherein the first pseudo random pause time and the second pseudo random pause time are different.

In accordance to an embodiment an unjamming process utilizes bidirectional agitation and non-deterministic behavior to clear debris that is jamming a downhole rotary tool. In accordance to an embodiment, the unjamming process comprises irregular oscillation of the jamming debris which may be produced by varying pause times in a bidirectional movement of the rotor. In some embodiments the rate of acceleration and deceleration of the rotor is maintained constant during the unjamming process.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
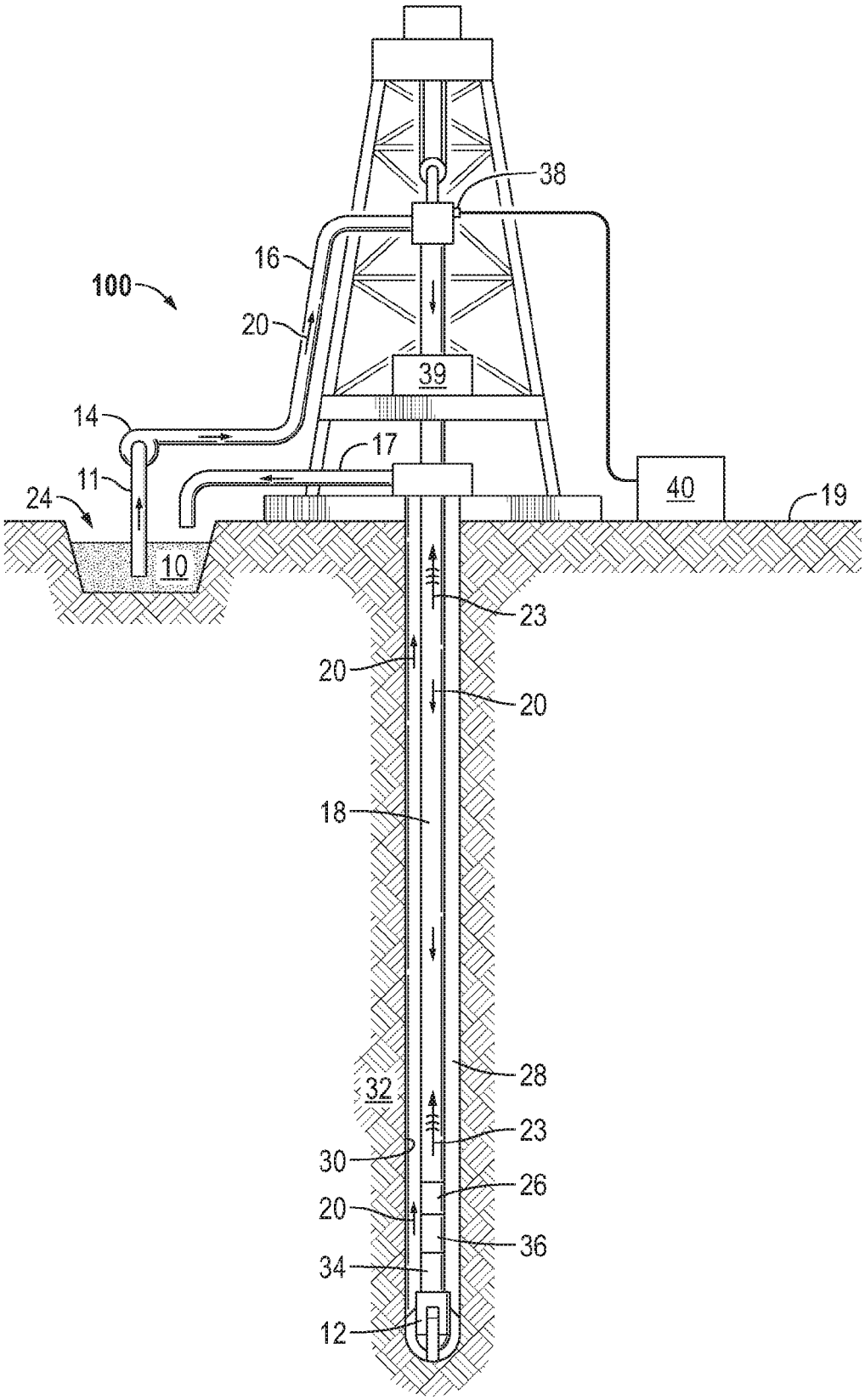
FIG. 1 illustrates a well system in which embodiments of an unjamming process to excite debris trapped in a downhole rotary tool can be utilized to unjam the rotary tool.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/ or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

FIG. 1 illustrates a well system in which unjamming methods can be utilized to remove debris from a downhole rotary tool 36 (e.g., a pulse signal device, modulator, or telemetry device) that is jamming the rotary tool 36 and preventing complete rotation of the rotor. In accordance to one or more embodiments a clearing or unjamming process utilizes bidirectional agitation and non-deterministic behavior to clear debris that is jamming a downhole rotary tool. In accordance to at least one embodiment the clearing or unjamming process comprises irregular oscillation of the jamming debris which may be produced by varying pause times in a bidirectional movement of the rotor. In some embodiments the rate of acceleration and deceleration of the rotor is maintained constant during the unjamming process.

In FIG. 1 a drill string 18 is suspended at an upper end for example by a kelly 39 and terminated at a lower end by a drill bit 12. The drill string 18 and drill bit 12 are rotated thereby drilling a borehole 30 into earth formation 32. Drilling fluid or drilling "mud" 10 is drawn from a storage container or "mud pit" 24 through a line 11 by the action of one or more mud pumps 14. The drilling fluid 10 is pumped into the upper end of the drill string 18 through a connecting mud line 16. Drilling fluid flows under pressure from the pump 14 downward through the drill string 18, exits the drill string 18 through openings in the drill bit 12, and returns to the surface of the earth by way of the annulus 22 formed by the wall of the borehole 30 and the outer diameter of the drill string 18. Once at the surface, the drilling fluid 10 returns to the mud pit 24 through a return flow line 17. Drill bit cuttings are typically removed from the returned drilling fluid by means of a "shale shaker" in the return flow line 17. The flow path of the drilling fluid 10 is illustrated by arrows 20.

A measurement while drilling ("MWD") section 34 including measurement sensors and associated control instrumentation may be mounted in a drill collar near the drill bit 12. The sensors respond to properties of the earth formation 32 penetrated by the drill bit 12, such as formation density, porosity and resistivity. In addition, the sensors can respond to drilling and borehole parameters such as borehole temperature and pressure, bit direction and the like. It should be understood that the MWD section 34 provides a conduit through which the drilling fluid 10 can readily flow. A downhole rotary tool 36 in the form of a pulse signal device, also referred to as a telemetry tool, is positioned in close proximity to the MWD 34. The rotary tool 36 converts the response of sensors in the MWD section 34 into corresponding pressure pulses within the drilling fluid column inside the drill string 18. These pressure pulses are sensed by a pressure transducer 38 at the surface 19 of the earth. The response of the pressure transducer 38 is transformed by a processor 40 into the desired response of the one or more downhole sensors within the MWD sensor section 34. The direction of propagation of pressure pulses is illustrated conceptually by arrows 23. Downhole sensor responses are, therefore, telemetered to the surface of the earth for decoding, recording and interpretation by means of pressure pulses induced within the drilling fluid column inside the drill string 18. In accordance with embodiments the rotary tool 36 comprises a rotary valve or "mud siren" pressure pulse generator, which repeatedly restricts the flow of the drilling fluid, and causes varying pressure waves to be generated in the drilling fluid at a frequency that is proportional to the rate of interruption. An example of a siren type telemetry device is described for example in U.S. Pat. No. 3,309,656, which is incorporated herein by reference. Downhole sensor response data is transmitted to the surface of the earth by modulating the acoustic carrier frequency.

Some telemetry and survey tools 36 rely on a continuously rotating rotor blade to transmit modulated real-time data to the surface. On occasion debris (e.g., cuttings, rock, shale), carried by the drilling fluid can find its way into this mechanism and prevent the rotor from spinning. This drop in communication can result in a negative impact on time, revenue and reputation. The methods disclosed herein define a semi-autonomous way of clearing debris from the rotor, providing a means to reduce the communication outage and increase the chances of self-recovery when debris does jam the rotor. As a consequence, the unjamming method diminishes the probability of needing to prematurely pull the drill string tool out of hole ("POOH").

Figure 2:
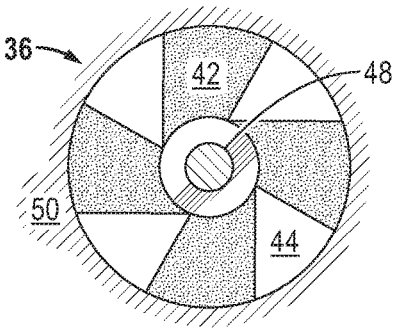
FIG. 2 is an end view along the axis of rotation of a downhole rotary tool (e.g., pulse signal device, mud siren) illustrating the rotor in a full open position according to one or more aspects of the disclosure.
Figure 3:
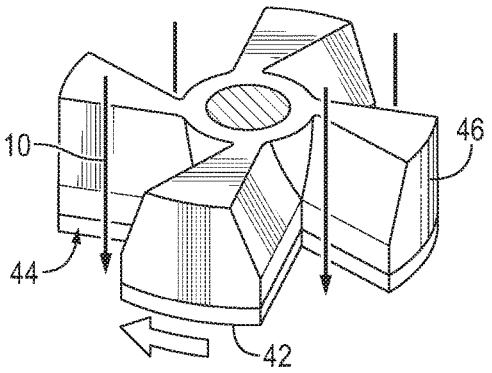
FIG. 3 illustrates a rotor and stator of a downhole rotary tool in a full open position according to one or more aspects of the disclosure.
Figure 4:
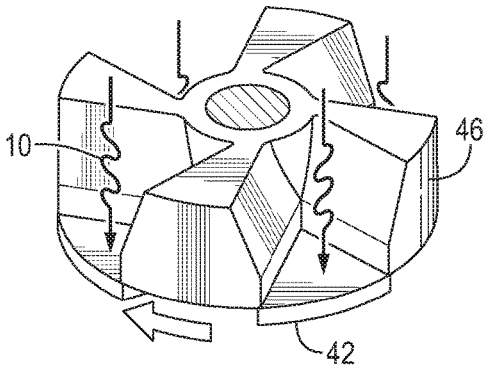
FIG. 4 illustrates a rotor and stator of a downhole rotary tool in a full closed position blocking fluid flow through the stator orifices according to one or more aspects of the disclosure.

With reference to FIGS. 2-6 a rotary tool 36 includes a rotor 42 and stator 46 positioned with a shaft 48 within a tubular housing or collar 50. A motor 26 (FIG. 1) spins the rotor 42 about an axis of rotation, represented by the shaft 48, to open and close axial fluid pathways 44 formed through the stator 46 of the rotary tool 36. FIG. 2 is an end view of a rotary tool 36 along the axis of rotation illustrating the rotor 42 in a full open position in accordance to aspects of the disclosure. FIGS. 3 and 4 are perspective views of a rotary tool 36 (e.g., rotor-stator assembly) respectively in a full open position and in a full closed position in accordance to aspects of the disclosure.

In a downhole rotary tool 36 such as a telemetry device it is the task of the rotor 42 to spin at a configurable rate, opening and closing a fluid pathway 44 through the through the rotary tool 36 for the drilling fluid 10 to travel. The rotor 42 typically changes between two states, a fully open position and a fully closed position. In the full open position fluid pathways 44 extending axially through the stator are fully open and unblocked by the rotor blades and in the full closed position the axial fluid pathways 44 are fully covered by the rotor blades. In some rotary tools an axial gap exists between the rotor and the stator. In the full closed position the cross-sectional area of the fluid pathway is blocked by the rotor blades and the tool is in the full closed position even if an axial gap exists between the rotor and stator.

Figure 5:
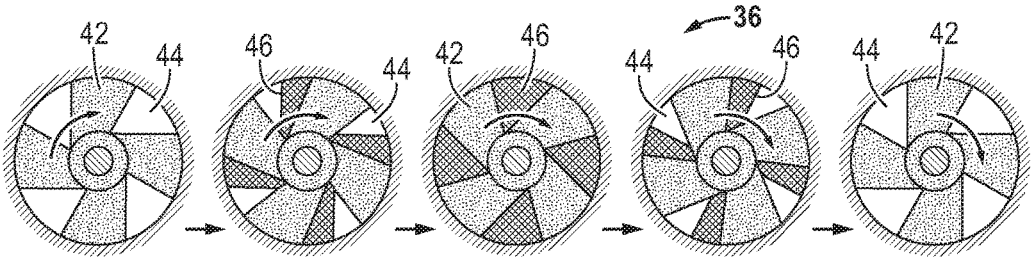
FIG. 5 illustrates a rotor of a downhole rotary tool progressing through a complete revolution of the rotor according to one or more aspects of the disclosure.

FIG. 5 schematically illustrates a rotor 42 of a rotary tool 36 rotating through complete revolution. In the far left view the axial fluid pathways 44 fully open and the stator is hidden behind the rotor. In the next view the fluid pathways 44 are partially covered by the rotor when the rotor and the stator 46 are rotationally offset from one another. In the middle view the rotor 42 if fully blocking the fluid pathways. If the rotor cannot seamlessly rotate through the full open and full closed positions then it is impeded from completing its task.

During normal operation it is to be assumed that the rotor 42 will spin freely at a variable velocity to open and restrict the flow of fluid, e.g., drilling fluid 10, through the drill string. During a jamming event the rotor becomes stuck in a partially open position. The conventional way to rectify this problem involves reversing the rotor back to the full open position to create a larger pathway. Once in the full open position the motor would stay dormant for a defined period of time for the mud pumps to push the debris through and clear the rotor. Passing the debris is dependent on the size and orientation of the debris. In practice this technique may work for some but not all jamming events. It can be said that due to lack of variance in downhole conditions the repeatability of this technique results in jamming events lasting many hours, even days. Also, due to the deterministic nature of this process, if the process fails a first time there is an increased likelihood that repeated attempts also will not be successful.

Figure 6:
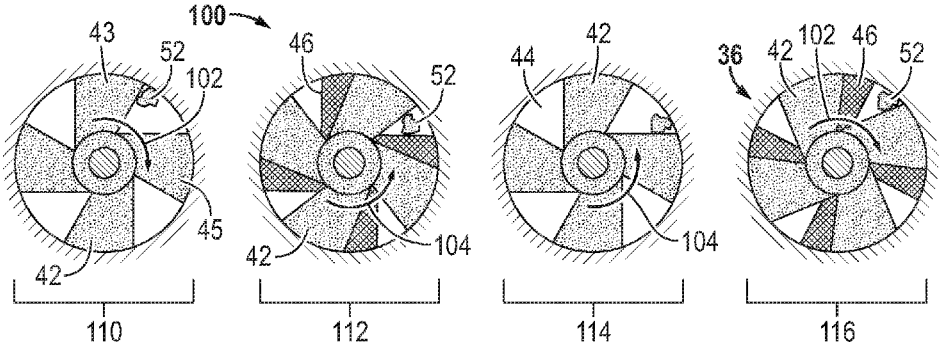
FIG. 6 illustrates bi-directional agitation of a debris particle jammed in a downhole rotary tool according to one or more aspects of an unjamming process the disclosure.
Figure 7:
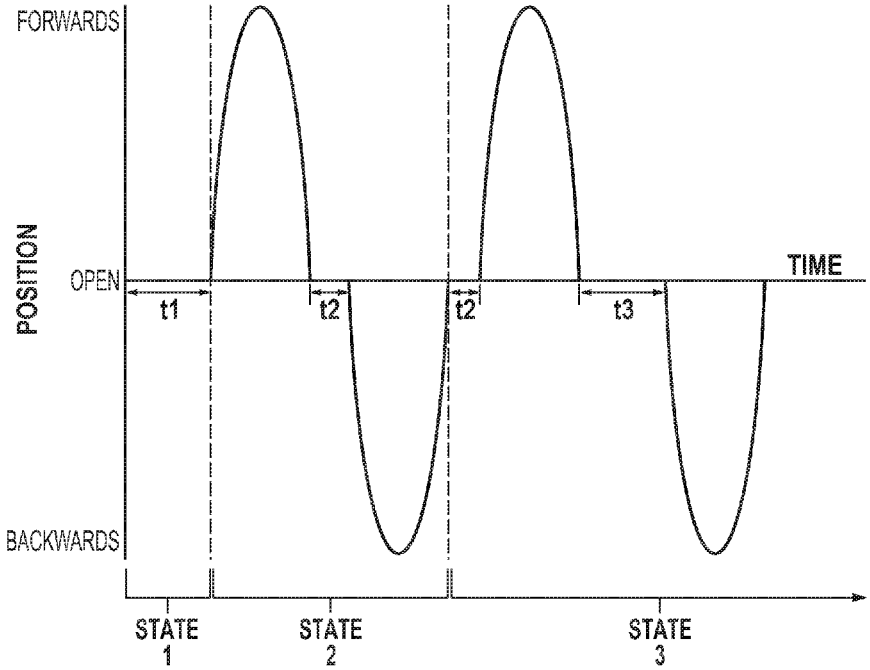
FIG. 7 is graphical illustration of rotor velocity over time illustrating three states of an unjamming wiggle process according to one or more aspects of the disclosure.
Figure 8:
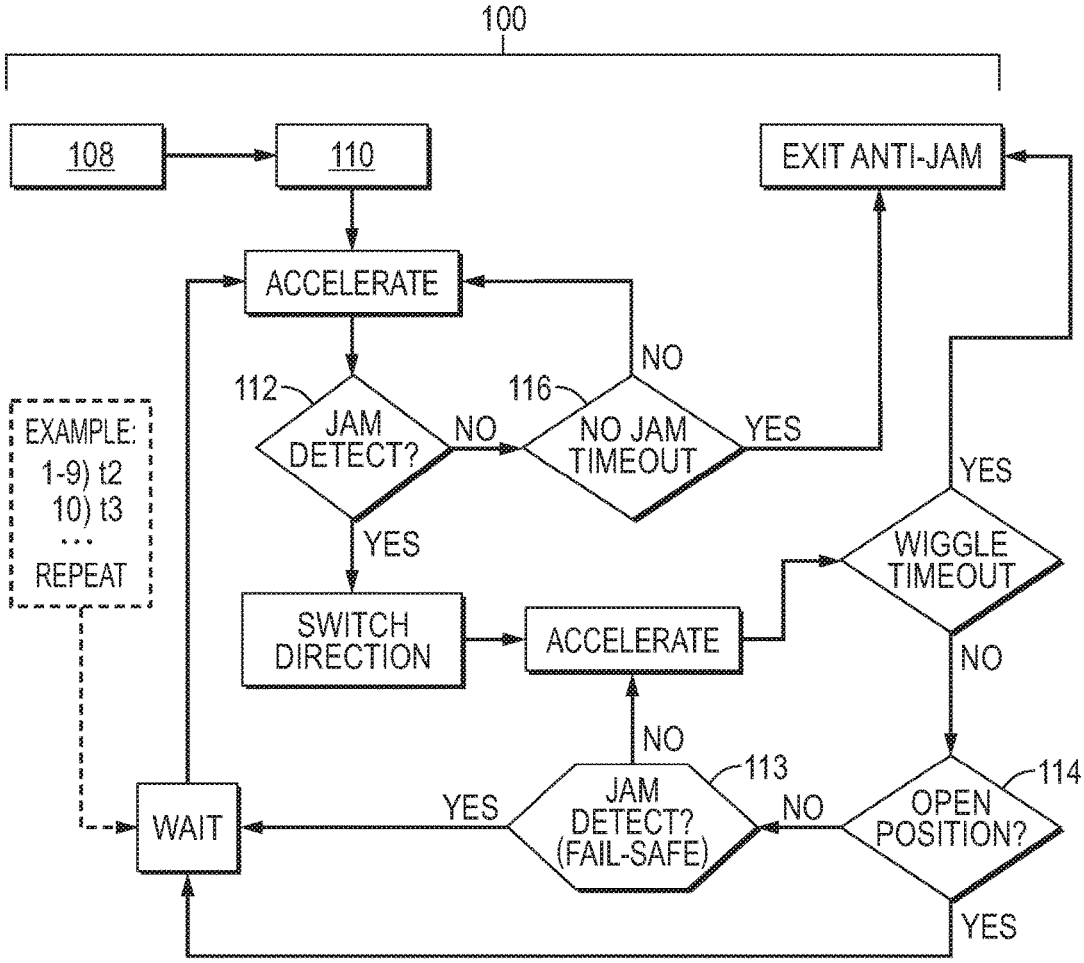
FIG. 8 is a flow diagram of an unjamming wiggle process according to one or more aspects of the disclosure.

Referring now to FIGS. 6-8, in conjunction with FIGS. 1-5, a new technique, referred to at times as "wiggle" or "unjamming wiggle," for removing debris trapped in a downhole rotary tool 36 (e.g., pressure pulse signal device) is described. The unjamming wiggle increases the probability dislodging the jamming debris and the rotary tool overcoming the jam. This anti-jam or unjamming wiggle technique utilizes a variable force acting on the debris perpendicular to the rotor (i.e. parallel with the fluid pathway) that is applied by the flow of drilling fluid 10, a repeated variable force (applied torque), and bi-directional agitation and non-deterministic behavior.

If the rotor 42 is unable to complete a quarter of a rotation, then by moving the rotor blades back and forth beyond the full open position any debris 52 trapped within the fluid pathways 44 will be acted upon by two different rotor blades instead of one, and in two different directions of travel as illustrated in FIG. 6. Due to inconsistencies in the physical dimensions of debris particle 52 sizes and shapes and the unconformable design of the rotor blades 42 this process provides the debris with many varied positions to pass through the fluid pathway 44.

An example of an unjamming process 100 is now described with reference to FIGS. 6 to 8. FIG. 6 illustrates the bi-directional agitation forces and FIG. 7 graphically illustrates non-deterministic behavior that may be implemented in the process as illustrated for example in FIG. 8. A jamming event occurs when a debris particle 52 is trapped between the in the fluid pathway 44 between adjacent rotor blades 43, 45 as illustrated in FIG. 6. When a jamming event occurs, block 108 of FIG. 8, the rotor 42 is rotated backwards to the full open position as shown in block 110 to initiate the unjamming process in a repeatable state. According to some embodiments, the rotor may be paused at the full open initiation position in block 110, for example for a period t1 (FIG. 7). After the initiation wait time (t1) in block 110 the rotor 42 is rotated in a first direction 102, e.g., forward, until a jammed is detected as illustrated in block 112 or the jamming process 100 is exited after a no jam timeout. Note that the rotor blade 42 acts on the debris 52 in the first direction 102 as the debris 52 is moved from one side of the fluid pathway 44 in block 110 to the other side in block 112. When the jam is detected in block 112 the direction of rotation is switched and the rotor 42 is rotated in the second direction 104 back to the full open position illustrated in block 114 and the rotation is again paused to allow the flow of drilling fluid to continue to act on the debris. The wait time at block 114 may vary between cycles for example as described below with regard to state-2 (t2) and state-3 (t3) and FIGS. 7 and 8. After the pause, or dead time, in the open position of block 114 the rotor is further rotated in the second direction 104 past the full open position until a jam is detected at block 116 or the unjamming process is exited after a timeout. Note that the rotor 42 acts on the debris 52 in the direction 104 moving from block 112 to 116. If a jam is detected at block 116 the cycle repeats. As further discussed below the wait times may be random instead of for a constant defined period of time. FIG. 8 includes a "Jam Detect [Fail-Safe]" condition at block 113 that exists in the case that the rotor is prevented from reaching the open position (block 114). In this scenario two simultaneous jam detections would occur without a wait period in between the jam detections. The fail-safe at block 113 provides the wait time to protect the tool electronics. There are several variables downhole to consider that aid the process of clearing debris from the rotor. Shock and vibration can play a role in this process; similarly changes in drilling fluid flow (pressure) by varying the speed of the mud pumps at the surface can also assist. However feedback has proven this variability alone is not enough, with some jamming events lasting multiple days.

Software by its very nature is deterministic, which is the complete opposite of what may be desirable during an unjamming procedure. If a particular process has failed to clear the debris from the rotor, then the likelihood of success is diminished in repeated attempts of the same method. Adding a random component into this procedure provides a seemingly infinite number of tests, therefore increasing the probability of success.

Varying rotor acceleration has the potential to introduce additional mechanical and electrical strain on the system, and it is also not the most efficient use of time, and does not use any forces perpendicular to the rotor that may be acting upon the debris. Instead the rotor accelerates and decelerates at a fixed rate and the frequency of the debris movement/oscillation is varied with a variable length dead time between rotations. Pausing the rotor when it is at the full open position provides the largest possible aperture for the pumps to force the debris through, thus gaining debris oscillation without compromising the primary way of debris clearance (i.e., drilling fluid flow).

The graph of FIG. 7 depicts rotor velocity over time with a negative velocity symbolizing backward rotation. There are three states to "wiggle," onset delay (state-1), fast irregular oscillation (state-2) and slow irregular oscillation (state-3). State-1 only occurs during initialization, this allows the motor 26 (FIG. 1) to stop rotation and start the process in a repeatable state. The initiation wait time is denoted t1 and may have a different duration than the state-2 and/or state-3 wait times. State-2 may be repeated successively for a predefined number of cycles before progressing to state-3. The time variable t2 denotes a short duration, state-2, wait or dead time. In state-2 the wait time is short relative to the state-3 wait time and may extend across a range of wait times so that two or more state-2 times can vary from one another and yet be considered short duration wait times relative to state-3 wait times. Thus, short pseudo random wait times are random and can vary in duration from one another and are maintained within a range of short time durations. State-3 excites the debris 52 using a slower frequency band than the state-2 frequency band and thus allows more time for the drilling fluid flow to wash out the debris and more time for the dispersal of accumulated heat from the electronic chassis. The time variable t3 denotes a state-3 long wait or dead time that is longer in duration than the state-2 time variable t2. The state-3 (long) pseudo random wait times are random and can vary in duration from one another and are of a longer duration than the short (state-2) pseudo random wait times. Within wiggle mode the motor control will alternate between state-2 and state-3, or successive cycles of state-2 and/or state-3, until a given timeout period has elapsed or the motor control has detected the rotor has been freely completing full rotations for a pre-defined period of time.

With reference to FIG. 7, an example of clearing a downhole rotary tool such as a pulse signal device includes detecting a jam with the fluid pathway in a partially open position, initiating an irregular oscillating clearing process by rotating the rotor to an initial full open position. The rotor movement may be paused for an initiation wait time (t1) when in the initial full open position. A first oscillation process, e.g., state-2, is performed until the jam is cleared or otherwise moving to a second oscillation process, the first oscillation process includes rotating the rotor in a first direction until jammed and then switching directions and rotating the rotor in a second direction to the full open position and pausing for a first pseudo random wait time and then rotating the rotor in the second direction until jammed and switching directions and rotating the rotor in the first direction to the full open position and pausing for the first pseudo random wait time. After performing the first oscillation process one or more times without clearing the jam a second oscillation process (state-3) is performed by rotating the rotor in a first direction until jammed and then switching directions and rotating the rotor in a second direction to the full open position and pausing for a second pseudo random wait time, wherein the first pseudo random wait time and the second pseudo random wait time are different. As illustrated in FIG. 7, the acceleration of the rotor from being paused and the deceleration to being paused can be at a constant rate.

The flow diagram of FIG. 8 illustrates this state machine and process of freeing or unjamming a downhole telemetry tool 36 utilizing the bi-directional agitation illustrated in FIG. 6 and the nondeterministic behavior discussed above with regard to FIG. 7. FIG. 8 illustrates nine cycles with t2 wait times followed by a t3 wait time. For example, for nine cycles or irregular oscillation processes the wait time (t2) will be relatively short compared to a later state-3 long random time period (t3). The wait time within a particular state can vary (be random) between successive cycles. The specified t2 and t3 wait periods shown in FIG. 8 are non-limiting examples.

In a non-limiting example, the state-2 short pseudo random wait time (t2) includes a range of wait times extending from about zero (0) to about five-hundred (500) milliseconds and the state-3 (t3) wait time is greater than the short pseudo random wait time. For example, a state-3 wait time may be about one second or greater. In accordance to a non-limiting example, the short pseudo random wait time t2 is in the range of about 0 to about 500 milliseconds and the long pseudo random wait time t3 is in the range of about 1 second to about 5 seconds or greater. Therefore, during a short wait cycle (t2) multiple oscillations of the rotor will vary between the restricted and the maximum speed of the motor, e.g., between about 2 Hz and a zero second wait time that may yield for example about 12 Hz in accordance to some embodiments. During a long wait cycle (t3) oscillation of about 1 to 5 seconds the rotor will vary between 1 Hz and 0.2 Hz. The longer duration state-3 wait time is intended in part to allow the motor drive system time to dissipate heat and to mitigate the risk of temperature related failure mode. For this reason the state-3 (t3) wait time can occur less regularly than the short duration (t2) wait time. As illustrated in the non-limiting example of FIG. 8, the state-3 wait time occurs one in ten wait times.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. References to "one embodiment" or "an embodiment" of the present disclosure are not intended to be interpreted as excluding the existence of additional embodiments that also incorporate the recited features. For example, any element described in relation to an embodiment herein is combinable with any element of any other embodiment described herein, unless such features are described as, or by their nature are, mutually exclusive. Those skilled in the art should also realize that such equivalent constructions do not depart from the spirit and scope of the disclosure, and that they may make various changes, substitutions and alterations herein without departing from the spirit and scope of the disclosure. The terms "a," "an" and other singular terms are intended to include the plural forms thereof unless specifically excluded.

What is claimed is:

1. A method, comprising:

operating a pulse signal device in a wellbore, the pulse signal device comprising a motor rotating a rotor relative to a stator to alter a fluid pathway to produce modulated pressure pulses in a drilling fluid column;

detecting a jam in the pulse signal device;

initiating an irregular oscillation clearing process by rotating the rotor to a full open position;

performing a first oscillation process until the jam is cleared or otherwise moving to a second oscillation process, the first oscillation process comprising:

rotating the rotor in a first direction until jammed and then switching directions and rotating the rotor in a second direction to the full open position and pausing for a first pseudo random pause time; and rotating the rotor in the second direction until jammed and then switching directions and rotating the rotor in the first direction to the full open position and pausing for the first pseudo random pause time; and performing a second oscillation process comprising:

rotating the rotor in a first direction until jammed and then switching directions and rotating the rotor in a second direction to the full open position and pausing for a second pseudo random time, wherein the first pseudo random pause time and the second pseudo random pause time are different.

2. The method of claim 1, wherein the initiating the irregular oscillation clearing process further comprises pausing the rotor in the full open position for an initiation pause time prior to performing the first oscillation process.

3. The method of claim 2, wherein the initiation pause time is longer than the first pseudo random pause time.

4. The method of claim 1, comprising repeating the first oscillation process prior to performing the second irregular oscillation process.

5. The method of claim 1, wherein the second pseudo random pause time is longer than the first pseudo random pause time.

6. The method of claim 1, further comprising using a constant rotor acceleration and deceleration in the first and the second oscillation processes.

7. The method of claim 1, further comprising pausing the rotor in the full open position for an initiation pause time prior to performing the first oscillation process; and using a constant rotor acceleration and deceleration in the first and the second oscillation processes.

8. The method of claim 7, wherein the second pseudo random pause time is longer than the first pseudo random pause time.

9. The method of claim 1, wherein the initiating the irregular oscillation clearing process further comprises pausing the rotor in the full open position for an initiation pause time prior to performing the first oscillation process; and wherein the initiation pause time is longer than the first pseudo random pause time and the second pseudo random pause time is longer than the first pseudo random pause time.

10. The method of claim 9, further comprising using a constant rotor acceleration and deceleration in the first and the second oscillation processes.

* * * * *